US005181464A

United States Patent [19]

Kuhlman et al.

[11] Patent Number: 5,181,464

[45] Date of Patent: * Jan. 26, 1993

[54] UNITARY PAPER IMPRESSION DEVICE

[75] Inventors: Marvin G. Kuhlman, Des Plaines; Daniel J. Finkiewicz, Elk Grove Village; Raymond J. Gradecki, Mundelein, all of Ill.

[73] Assignee: NCM International, Inc., Arlington Heights, Ill.

[ * ] Notice: The portion of the term of this patent subsequent to Oct. 8, 2008 has been disclaimed.

[21] Appl. No.: 749,289

[22] Filed: Aug. 23, 1991

Related U.S. Application Data

[63] Continuation of Ser. No. 508,049, Apr. 10, 1990, Pat. No. 5,054,389.

[51] Int. Cl.[5] ..... B31F 1/07

[52] U.S. Cl. ..... 101/28; 101/3.1

[58] Field of Search ..... 101/4, 18-21, 101/28-32, 3.1

[56] References Cited

U.S. PATENT DOCUMENTS 2,948,214 8/1960 Lotsch ..... 101/31.1

*Primary Examiner*—Edgar S. Burr
*Assistant Examiner*—Christopher A. Bennett
*Attorney, Agent, or Firm*—Wallenstein, Wagner & Hattis, Ltd.

[57] ABSTRACT

A unitary paper impression device (10) that is small, light and safe and that can emboss impressions into paper (12) with ease and minimal effort is disclosed. The device (10) includes a male embossing section (20) which has a contacting face surface (22) and an opposite back surface (27), the face surface (22) being a face plane (28) and at least one outwardly extending projection (23) therefrom. The device (10) also includes a female embossing section (30) which has a contacting face surface (32) and an opposite back surface (37), the face surface (32) being a face plane (38) and at least one complimentary inwardly extending trough (33) therein for receiving each projection (23) of the male embossing section (20). An interconnecting, bendable web (40) contiguous with the back surfaces (27,37) is further provided for hingedly connecting the sections (20,30) so that their respective faces (22,32) can mate to impress an image in a piece of paper (12) disposed therebetween.

11 Claims, 1 Drawing Sheet

FIG. 1
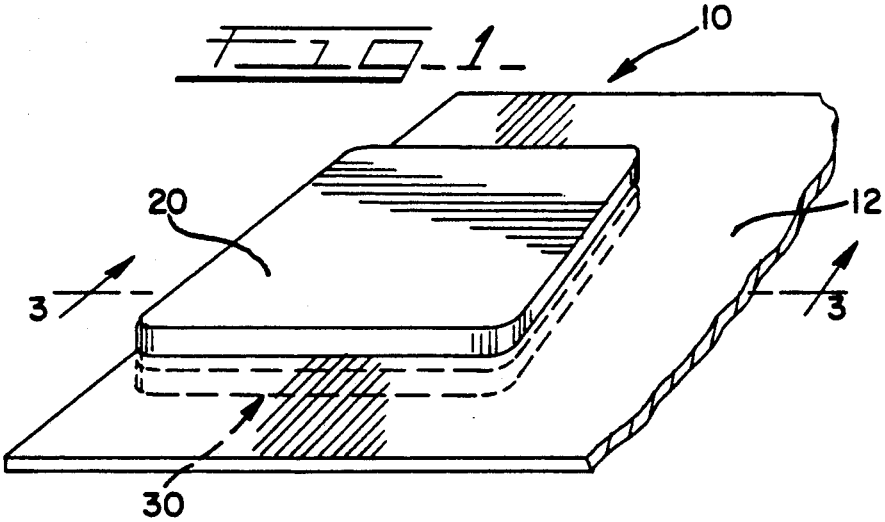
FIG. 2
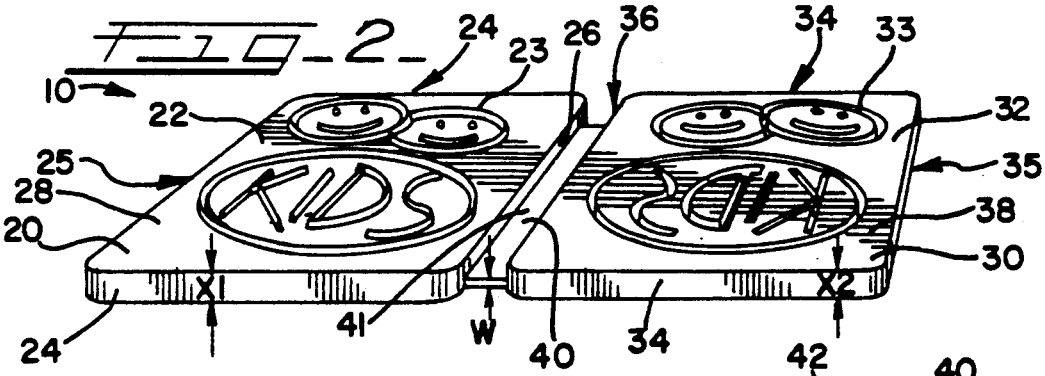
FIG. 4
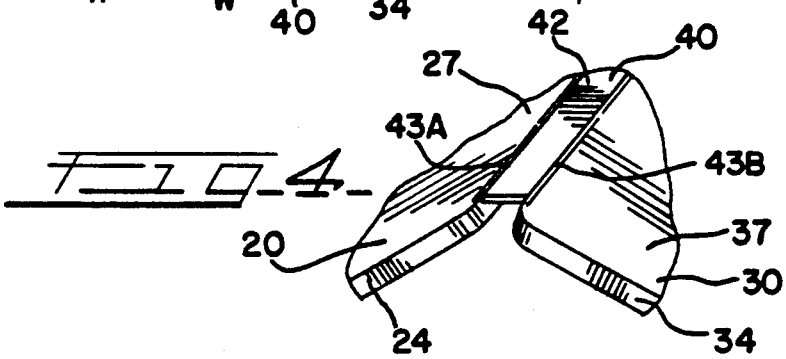
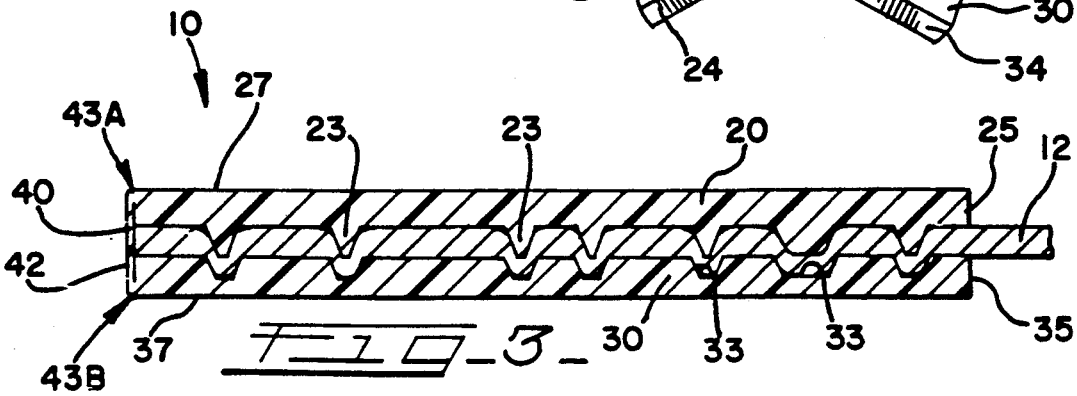
FIG. 3

UNITARY PAPER IMPRESSION DEVICE

REFERENCE TO RELATED APPLICATIONS

This application is a continuation application from Ser. No. 508,049, filed Apr. 10, 1990, issued on Oct. 8, 1991 as U.S. Pat. No. 5,054,389.

TECHNICAL FIELD

This invention relates generally to embossing and, more particularly, to a unitary device that is small, light and safe that can emboss impressions into paper with ease and minimal effort.

BACKGROUND PRIOR ART

Embossing devices are used to impress images into materials, such as paper. They serve as an alternative to printing images onto materials. Many times such devices are used on documents in lieu of printing because it is believed that impressed images are harder to forge or alter. Other times embossing devices are used because they make documents look more official. And, still other times embossing devices are used just for fun and amusement.

Previous designs of embossing devices are large, heavy and involve many parts. For example, U.S. Pat. No. 1,489,097 discloses a toy for cutting figures that has a main body with a handle. A separate male/female metal element is placed into the main body. When the handle is pressed, there is a clamping response that closes the male/female element which cuts the object placed between the male and female sections. U.S. Pat. No. Des. 284,722 discloses an embossing device that has two mating elements connected by a pin element. And, U.S. Pat. No. Des. 28,799 discloses a seal press case that has two circular dish-shaped members terminating in stems which are joined by a tube that is traversed by the base of a stirrup-shaped ring.

Because these prior embossing devices have many parts, they are more likely to break. Also, by having many parts, especially hinges, these devices can be unsafe. An individual's finger or skin can get caught and pinched when the device is closed. Further, another problem is that because they are so large and heavy, children, and often others, have difficulty holding and working them.

Moreover, the use of a plastic unitary embosser has herebefore not been successful because, on the one hand, the use of a rigid, stiff plastic would prevent the device from bending and closing, and, on the other hand, the use of a soft, pliable plastic would make repeated use of the device virtually impossible because each use would require a realignment of the embossing sections.

SUMMARY OF THE INVENTION

According to the present invention, a unitary paper impression device has been developed that is both light and easy to work. The present device is also very safe, permitting children and adults to play with and enjoy it.

Generally, the present invention includes two sections, a male section and a female section, and an interconnecting web.

Specifically, the paper impression device is unitary and, as such, is only one piece. The male embossing section, which has a contacting face surface and an opposite back surface, is defined by end and side surfaces. The face surface comprises a face plane that has a plurality of outwardly extending projections protruding therefrom. The female embossing section, which also has a contacting face surface and an opposite back surface, is defined by end and side surfaces. And, the face surface comprises a face plane with a plurality of complimentary inwardly extending troughs cut therein. The projections form an image, and the troughs form a complimentary, mirror image of these projections. There is a bendable web contiguous with the sections' back surfaces for hingedly connecting these embossing sections so that their respective face surfaces can mate to impress a piece of paper disposed therebetween. The two sections are constructed so that the male section's projections align with and can be received by the female section's troughs. In the preferred embodiment, the web is thinner than the embossing sections and has dual hinges transversing it. Moreover, for efficient, clean and safe use and to reduce the risk of breaking the paper being impressed, the projections are tapered towards each's outermost point from the face plane and the troughs are beveled towards each's innermost point from the face plane.

BRIEF DESCRIPTION OF DRAWINGS

FIG. 1 shows a perspective view of an embodiment of the paper impression device made in accordance with the present invention that is in the closed position with a piece of paper disposed therein;

FIG. 2 shows a perspective view of an embodiment of the paper impression device made in accordance with the present invention that is in the opened position;

FIG. 3 shows a cross-sectional view, taken along line 3—3 in FIG. 1; and, FIG. 4 shows a partial perspective view of the back side of an embodiment of the paper impression device made in accordance with the present invention that is in the partially open position.

DETAILED DESCRIPTION

While this invention is susceptible of embodiment in many different forms, there is shown here in the drawings and will herein be described in detail a preferred embodiment of the invention with the understanding that the present disclosure is to be considered as an exemplification of the principles of the invention and is not intended to limit the broad aspect of the invention to the embodiment illustrated.

FIG. 1 of the drawings shows a paper impression device 10 that is engaging a sheet of paper 12. In this Figure, the device 10 is in the closed position with the paper 12 disposed between the male embossing section 20 and the female embossing section 30.

Shown in more detail in FIG. 2, the device 10, shown here in its open position, has two main sections, the male embossing section 20 and the female embossing section 30. The male section 20 has both a contacting face surface 22 and a back surface 27 that are both defined by contiguous end surfaces and contiguous side surfaces. Specifically, there is an outer end surface 25, an opposed inner end surface 26, and two side surfaces 24. Similarly, the female section 30 has both a contacting face surface 32 and a back surface 37 that are both defined by an outer end surface 35, an opposed inner end surface 36, and side surfaces 34. The end surfaces 35,36 and side surfaces 34 are also contiguous with the contacting face 32 and with the back surface 37.

While the embossing sections 20,30 have been shown to be rectangular, it is appreciated that they can be other shapes, such as, for example, circular, square and triangular.

The male embossing section's contacting face surface 22 is composed of a face plane 28, which is generally flat, and a plurality of outwardly extending projections 23. The projections 23 protrude from the face plane 28 and form one or more images. For example, the images formed by the projections 23 in FIG. 2 are two overlapping "Happy Faces" and the letters "K-I-D-S" in a circle.

The contacting face surface 32 of the female embossing section 30 includes a face plane 38 and a plurality of inwardly extending troughs 3 cut into the plane 38. The plane 38 is generally flat and the troughs 33 extend inwardly from this plane 38. The troughs 33 cut into the plane 38 are constructed so as to be negative images, mirror images or complimentary images of the images formed by the projections 23 of the male embossing section 20. Thus, there is generally a one to one correspondence between the male section's projections 23 and the female section's troughs 33.

A web 40 connects the male section 20 to the female section 30. The web has both a back surface 42 and a front surface 41, and a cross-sectional thickness W. This web 40 is not only unitary with both the sections 20,30, but is also contiguous with each section's back surface 27,37. As shown in more detail in FIG. 2, the web 40 has a thinner cross-sectional thickness W than the mating sections 20,30 (cross-sectional thicknesses of X1 and X2). The web also has memory capabilities. This web 40 has both pliable and rigid characteristics. In particular, the web 40 is bendable and acts as a hinge permitting the device 10 to repeatedly go from its open position, shown in FIG. 2, to its closed or mating position, shown in FIGS. 1 and 3. The closed position is defined as that position wherein the projections 23 of the male section 20 are mating and in alignment with the troughs 33 of the female section 30. In short, the web 40 can bend yet hold its hinge. By having a web 40 with memory capabilities, it is possible to repeatedly open and close the device 10 without adjusting or realigning the sections 20,30 each time.

Specifically, to emboss paper 12 or other contents, one places the item to be impressed between the two contacting face surfaces 22,32 while the device 10 is slightly opened. The device 10 is then closed so that the paper is sandwiched between the two face surfaces 22,32. Next, pressure is applied to the back surfaces 27,37 of the sections 20,30 by squeezing, which, in turn, pushes the contacting face surfaces 22,32 towards each other. As shown particularly in FIG. 3, the paper 12 is deformed by the projections 23 fitting into the aligned, complimentary troughs 33. The contacting face surfaces 22,32 of the two sections 20,30 engage, mate and impress an image into the paper 12 disposed therebetween. When the device 10 is then opened, an impression of the image is embossed into the paper 12.

With regards to the web 40, it has been found that the best way to accomplish this memory capability and capacity is to form two transverse hinges 43A,43B into the web 40. Specifically, as shown in more detail in FIG. 4, when the device 10 is made to go from its open position to its closed position by the user or manufacturer, the two sections 20,30 mate and two permanent, generally linear, hinges 43A,43B are formed into the web 40.

In the preferred embodiment, it has been found that the device 10 embosses cleaner and more efficiently when each projection 23 of the male embossing section 20 is tapered towards its outer most point from the face plane 28 and when each trough 33 of the female embossing section 30 is beveled towards its innermost point from the face plane 38. In this manner, the inclined walls of the tapered projections 23 slide into and out of the inclined walls of the beveled troughs 33. This arrangement of having cuneal projections 23 and cuneal troughs 33 not only makes a cleaner impression on the paper 12, but also minimizes the risks of damaging the paper 12 being embossed therebetween. Additionally, having this construction reduces the chances of breaking or damaging the contacting face surfaces. Such a construction is further safer in that it eliminates sharp edges on the contacting face surfaces 22,32.

While one or more embodiments of the invention have been herein illustrated and described in detail, it will be understood that modifications and variations thereof may be effected without departing from the spirit of the invention and the scope of the appended claims.

We claim:

1. A unitary impression device consisting of:

a first embossing section having a contacting face surface and an opposite back surface, said face surface being a face plane with at least one outwardly-extending projection therefrom;

a second embossing section having a contacting face surface and an opposite back surface, said face surface being a face plane with at least one complimentary inwardly-extending trough therein for receiving each said projection of said first embossing section; and, a bendable web with at least one generally linear permanent hinge formed therein contiguous with said back surfaces for hingedly connecting said two embossing sections, means enabling said embossing sections to be repeatably movable between a first position and a second position without additional structure for realignment, in said first position said back surfaces of said embossing sections face substantially the same direction and in said second position said respective face surfaces of said embossing sections mate to impress a content placed therebetween, said embossing sections normally moving from said first position to said second position to provide an impression.

2. The impression device of claim 1 wherein said web has dual hinges transversing it.

3. The impression device of claim 2 wherein said web is thinner than said embossing sections.

4. The impression device of claim 1 wherein each said projection of said first embossing section is tapered.

5. The impression device of claim 4 wherein each said trough of said second embossing section is beveled.

6. A unitary paper impression device having two embossing sections and an interconnecting web therebetween consisting of:

complimentary contacting face surfaces on each of the embossing sections for engaging one another and for impressing an image into a sheet of paper disposed therebetween; and, back surfaces opposite said face surfaces on each of the embossing sections for receiving the web disposed therebetween, means enabling said embossing sections to be repeatably movable between a first position and a second position without additional structure for realignment, in said first position said back surfaces of said embossing sections face substantially the same direction and in said second position said face surfaces of said embossing sections engage and mate with one another, and the web having at least one generally linear permanent hinge formed therein, said embossing sections normally moving from said first position to said second position to provide an impression.

7. The impression device of claim 6 wherein one face surface has an image thereon formed by at least one outwardly extending projection and the other face surface has a complimentary image thereon formed by at least one inwardly extending trough.

8. The impression device of claim 7 wherein each said projection is tapered and each said trough is beveled.

9. The impression device of claim 6 wherein the web is thinner than the embossing sections and has two hinges therein.

10. A unitary paper impression device consisting of:

a male embossing section having a face surface and an opposite back surface, said face surface having at least one image thereon formed by tapered outwardly-extending projections therefrom;

a female embossing section having a face surface and an opposite back surface, said face surface having at least one complimentary image thereon formed by beveled inwardly-extending troughs therein for receiving said projections of said male embossing section; and, a bendable web with least one generally linear permanent hinge formed therein contiguous with said back surfaces for hingedly connecting said sections, means enabling said embossing sections to be repeatably movable between a first position and a second position without additional structure for realignment, in said first position said back surfaces of said embossing sections face substantially the same direction and in said second position said respective face surfaces of said embossing sections mate to impress each said image in a piece of paper disposed therebetween, said embossing sections normally moving from said first position to said second position to provide an impression.

11. The impression device of claim 10 wherein said web has dual hinges transversing it.

* * * * *